United States Patent [19]

Lee et al.

[11] Patent Number: 4,782,766

[45] Date of Patent: Nov. 8, 1988

[54] AUTOMATIC COMBUSTION CONTROL FOR A ROTARY COMBUSTOR

[75] Inventors: Suh Y. Lee, Monroeville; William G. Collins, Jr., Greensburg, both of Pa.; John T. Healy, Irvine, Calif.

[73] Assignee: Westinghouse Electric Corp., Pittsburgh, Pa.

[21] Appl. No.: 18,682

[22] Filed: Feb. 25, 1987

[51] Int. Cl.[4] ..... F23N 5/02

[52] U.S. Cl. ..... 110/190; 110/234; 110/246; 236/15 E

[58] Field of Search ..... 110/185, 186, 188, 190, 110/203, 233, 234, 235, 246, 255, 257, 258, 297; 432/103, 116, 118; 236/15 E, 15 BD, 15 BG, 15 BR, 14

[56] References Cited

U.S. PATENT DOCUMENTS

| | | | |
|---|---|---|---|
| 3,822,651 | 7/1974 | Harris et al. | 110/246 X |
| 4,060,042 | 11/1977 | Baraldi et al. | 110/190 X |
| 4,066,024 | 1/1978 | O'Connor | 110/246 X |
| 4,226,584 | 10/1980 | Ishikawa | 110/246 X |
| 4,395,958 | 8/1983 | Caffyn et al. | 110/246 |
| 4,424,754 | 1/1984 | Coleman et al. | 110/185 X |
| 4,437,418 | 3/1984 | Guillame et al. | 110/234 X |
| 4,459,923 | 7/1984 | Lewis | 110/185 X |
| 4,495,872 | 1/1985 | Shigaki | 110/188 X |
| 4,516,929 | 5/1985 | Hiroi et al. | 236/15 E X |

FOREIGN PATENT DOCUMENTS

| | | | |
|---|---|---|---|
| 0012091 | 6/1980 | European Pat. Off. . | |
| 1451511 | 1/1969 | Fed. Rep. of Germany . | |
| 25609 | 3/1981 | Japan | 110/188 |
| 613920 | 1/1949 | United Kingdom . | |

OTHER PUBLICATIONS

Patent Abstracts of Japan, vol. 8, No. 197 (M-324)(1634), Sep. 11, 1984, abstracting: JP-59-8681-4(A) (Sanki Kogyo K.K.), May 19, 1984.

Patent Abstracts of Japan, vol. 5, No. 93 (M-74)(765), Jun. 17, 1981, abstracting: JP-56-40018(A) (Takuma K.K.), Apr. 16, 1981.

*Primary Examiner*—Steven E. Warner

[57] ABSTRACT

A combustion controller controls the supply of combustion gas to the combustion barrel of a rotary combustor used for incinerating solid waste material. The rotary combustor includes a combustion barrel having a gas-porous side wall and windboxes underneath the combustion barrel to supply the combustion gas to support incineration of the waste material into combustion products which include exhaust gases. The windboxes receive combustion gas via individual control ducts which are controlled by the combustion controller to regulate the corresponding supplies of combustion gas and thereby to provide substantially complete incineration of the solid material. An oxygen sensor detects the percentage of oxygen present in the exhaust gases and the combustion gas supplied to the combustion barrel is controlled to maintain the percentage of oxygen near a predetermined level. In addition, flame and temperature sensors may detect temperature and the existence of a flame, respectively, in an area above each of the windboxes, so that the combustion gas supplied to each windbox can be individually controlled.

5 Claims, 4 Drawing Sheets

AUTOMATIC COMBUSTION CONTROL FOR A ROTARY COMBUSTOR

BACKGROUND OF THE INVENTION

1. Field of the Invention

The present invention is related to a rotary combustor, or incinerator, for waste material and, more particularly, to automatic control of combustion gas supplied to a rotary combustor.

2. Description of the Related Art

Proper disposal of solid waste has become an increasingly serious problem as existing sites for land disposal near capacity and new sites become increasingly difficult to locate while the amount of toxic chemicals, particularly in municipal waste, appears to be increasing. Incineration of combustible solid waste has long been used to reduce the quantity of solid matter needing disposal. However, existing methods of incineration often result in incomplete combustion and produce exhaust gases which include carbon monoxide and unburned hydrocarbons.

One device which is used for incinerating municipal solid waste is known as a water-cooled rotary combustor. Examples of water-cooled rotary combustors are described in U.S. Pat. Nos. 3,882,651 to Harris et al.: 4,066,024 to O'Connor; and 4,226,584 to Ishikawa. A general description of a rotary combustor is provided immediately below and a more detailed description will be provided later.

As illustrated schematically in a cross-sectional side elevational view in FIG. 1A, a water-cooled rotary combustor generally includes a combustion barrel 10 having a generally cylindrical side wall 36 affixed to annular support bands 13 which are received on rollers 12 to permit rotation of the barrel 10 about its longitudinal axis. The barrel 10 has a generally open input end 16 for receiving material to be burned, such as municipal solid waste 14 which varies in moisture content and heating value. A second or exit end 18 of the barrel 10 is disposed in a flue 19. Exhaust gases 20 and solid combustion products 22, i.e., ash, exit the combustion barrel 10 at the exit end 18. The barrel 10 is cooled by cooling pipes 24 joined by gas-porous interconnections 25 to form the generally cylindrical side wall 36 of the barrel 10. Due to the variable nature of municipal solid waste, it is difficult to maintain a constant feed rate of the waste into and through the barrel 10, and thus the location and strength of the fire 26 in the barrel 10 varies over time. As a result, the constitution of the exhaust gases 20 varies widely over time as illustrated in FIG. 2 with respect to percentage of oxygen. Such variation is an indication that the waste material 14 is burning unevenly.

SUMMARY OF THE INVENTION

An object of the present invention is to maintain efficient combustion in a rotary combustor.

Another object of the present invention is to minimize the discharge of carbon monoxide and unburned hydrocarbons from a rotary combustor utilized in a process of burning municipal solid waste.

Yet another object of the present invention is to automatically control the supply of combustion gas to a rotary combustor so that combustible material is substantially completely incinerated in the rotary combustor.

A further object of the present invention is to sense changes in combustion occurring in a rotary combustor and in response to such changes, automatically to adjust the supply of combustion gas to the rotary combustor.

The above objects are attained by the method of the present invention for controlling the supply of combustion gas to a rotary combustor utilized for burning solid waste material. The method of the present invention comprises the steps of sensing a predetermined operating characteristic of the rotary combustor to produce a sensor signal and automatically controlling the combustion gas supplied to the rotary combustor in dependence upon the sensor signal to maintain the predetermined operating characteristic according to desired, predetermined criteria.

According to a first embodiment of the present invention, the predetermined operating characteristic which is sensed is a relative quantity of a specific component gas in the exhaust gases. Accordingly, in the first embodiment, the combustion gas supplied to the rotary combustor is controlled to maintain the relative quantity of that specific component gas within a predetermined range. Preferably, the percentage of oxygen present in the exhaust gases is used as the predetermined operating characteristic.

According to a second embodiment of the present invention, the predetermined operating characteristic is a fire characteristic indicated by a fire characteristic sensor signal. In the second embodiment, the combustion gas supplied to the rotary combustor is automatically controlled in dependence upon the fire characteristic sensor signal to maintain the fire characteristic according to the predetermined criteria. The fire characteristic may be temperature or the existence of a flame. Preferably, the fire characteristic is sensed by a photoelectric cell which detects infrared radiation, or ultraviolet radiation, depending on whether temperature or flame, respectively, is to be detected. The second embodiment is applicable to a rotary combustor comprising a plurality of windboxes underneath a combustion barrel having a gas-porous side wall. In this case, there are preferably a plurality of fire characteristic sensors, each detecting the fire characteristic in an area above a corresponding windbox.

These objects, together with other objects and advantages which will be subsequently apparent, reside in the details of construction and operation as more fully hereinafter described and claimed, reference being had to the accompanying drawings forming a part hereof, wherein like reference numerals refer to like parts throughout.

DESCRIPTION OF THE PREFERRED EMBODIMENT

Figure 1A:
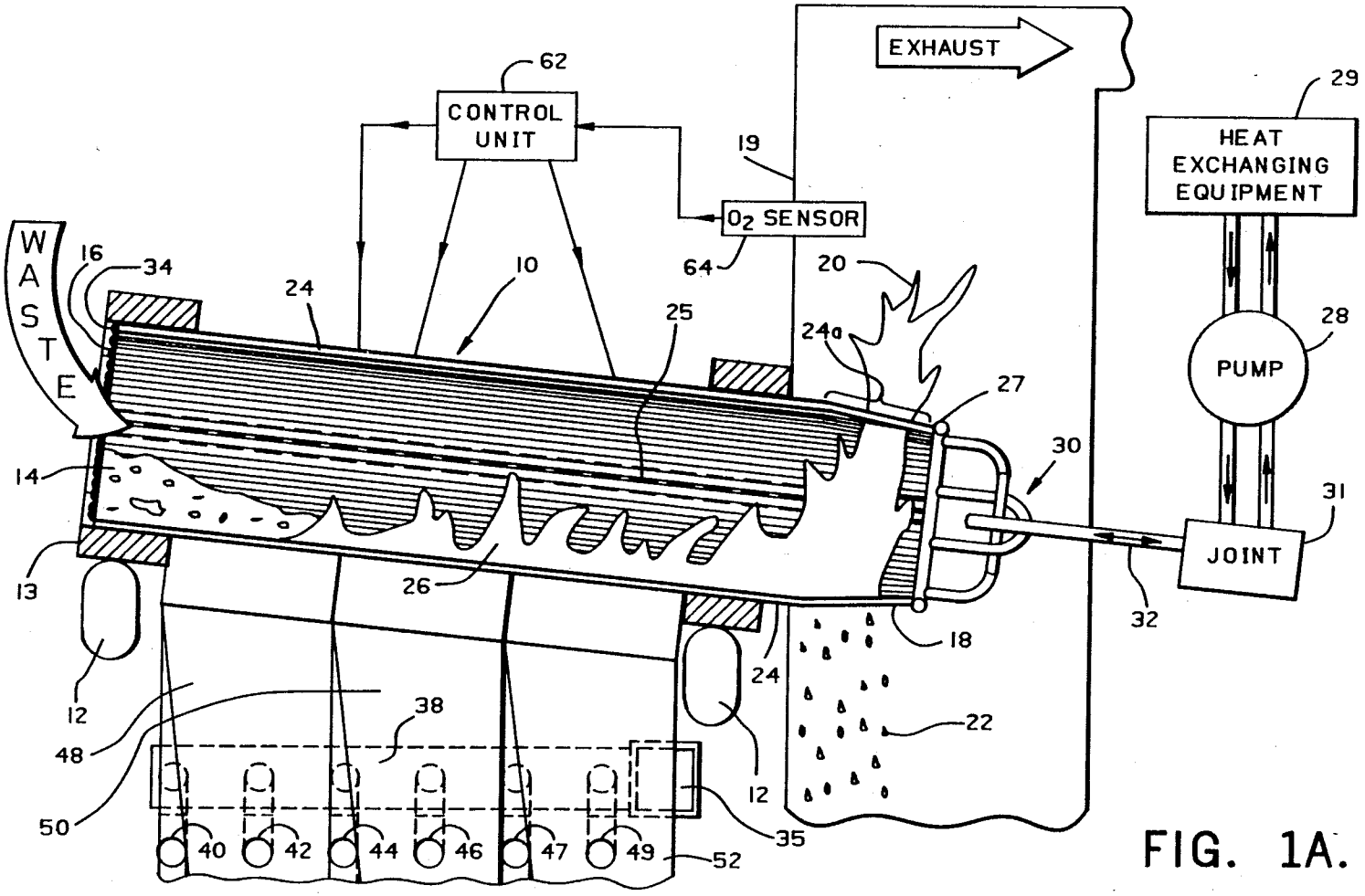
FIG. 1A is a cross-sectional, side elevational schematic view of a rotary combustor incorporating a combustion controller according to the present invention.

In a typical rotary combustor, such as that described in U.S. Pat. No. 3,882,651 to Harris et al., incorporated herein by reference, and with concurrent reference to Figs. 1A, 1B and 3A hereof, a watercooled combustion barrel 10 is generally cylindrical in shape, having a generally cylindrical side wall 36 formed of longitudinally extending cooling pipes 24 and gas-porous interconnections 25, such as perforated webs (FIG. 1A illustrating only a few such webs 25 between adjacent cooling pipes 24). The combustion barrel 10 has a central axis of rotation which is inclined slightly from the horizontal, proceeding downwardly from the input end 16 to the exit end 18. Thus, the cooling pipes 24 and perforated webs 25 are also slightly inclined from the input end 16, until the pipes 24 bend inside the flue 19 at which point the perforated webs typically end. The cooling pipes 24 have first and second ends disposed adjacent the exit end 18 and the input end 16, respectively, of the barrel 10.

Figure 3B:
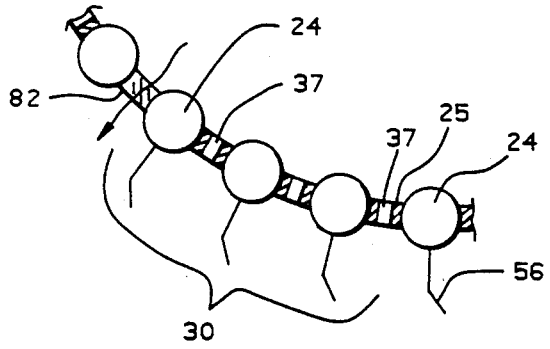
FIG. 3B is an enlargement of a fragmentary segment of the structure of FIG. 3A.

The perforated webs 25 are preferably formed of bar steel having openings 37 (FIG. 3B) therein, for supplying combustion gas, typically air, to the interior of the combustion barrel 10 to support combustion of waste material 14 therein. The webs 25 extend from the input end 16 and along the generally straight axial portions of the pipes 24 to an angled section **24*a* inside the flue 28. No webs 25 are typically included after the angled section 24*a* in which the cooling pipes 24 extend in a somewhat converging relationship to the exit end 18 of the barrel 10, permitting exhaust 20, including exhaust gases and solid particles such as fly ash, and solid combustion products 22, e.g., ash and cinders, to escape more easily from the barrel 10**.

The combustion barrel 10 is encircled by bands 13 of generally annular configuration which are suitably connected to the outer periphery of the generally cylindrical array of pipes 24 and which in turn are received on the rollers 12. The barrel 10 may be rotated by either driving the rollers 12 or directly driving the barrel 10 using a chain drive or a separate ring gear (not shown) secured to the barrel 10 and driven by a pinion gear, as disclosed in Harris et al. '651.

The barrel 10 is cooled by circulating coolant through the cooling pipes 24. The resulting high-energy coolant is discharged from the barrel 10 via a ring header 27 and supply pipes 30. The high-energy coolant discharged by the supply pipes 30 is circulated by a pump 28 through a rotary joint 31, such as the joint disclosed in Harris et al. '651, to heat exchanging equipment 29 which returns low-energy coolant to the ring header 27 via the pump 28, joint 31 and supply pipes 30. The supply pipes 30 preferably include a double-walled, or coaxial, pipe 32 for connection to the joint 31. The ring header 27 distributes the low-energy coolant received from the heat exchanging equipment 29 to a first set of the cooling pipes 24 which transport the coolant the length of the barrel 10 to return means, such as U-tubes 34, at the input end 16 of the barrel 10. The U-tubes 34 couple the first set of the cooling pipes 24 to a second set of the cooling pipes 24 which return the coolant to the ring header 27 to be discharged to the heat exchanging equipment 29. The heat exchanging equipment 29 may include a boiler, a condenser, connection to a steam driven electrical power generating system, etc. (all not shown) as known in the art.

Figure 1B:
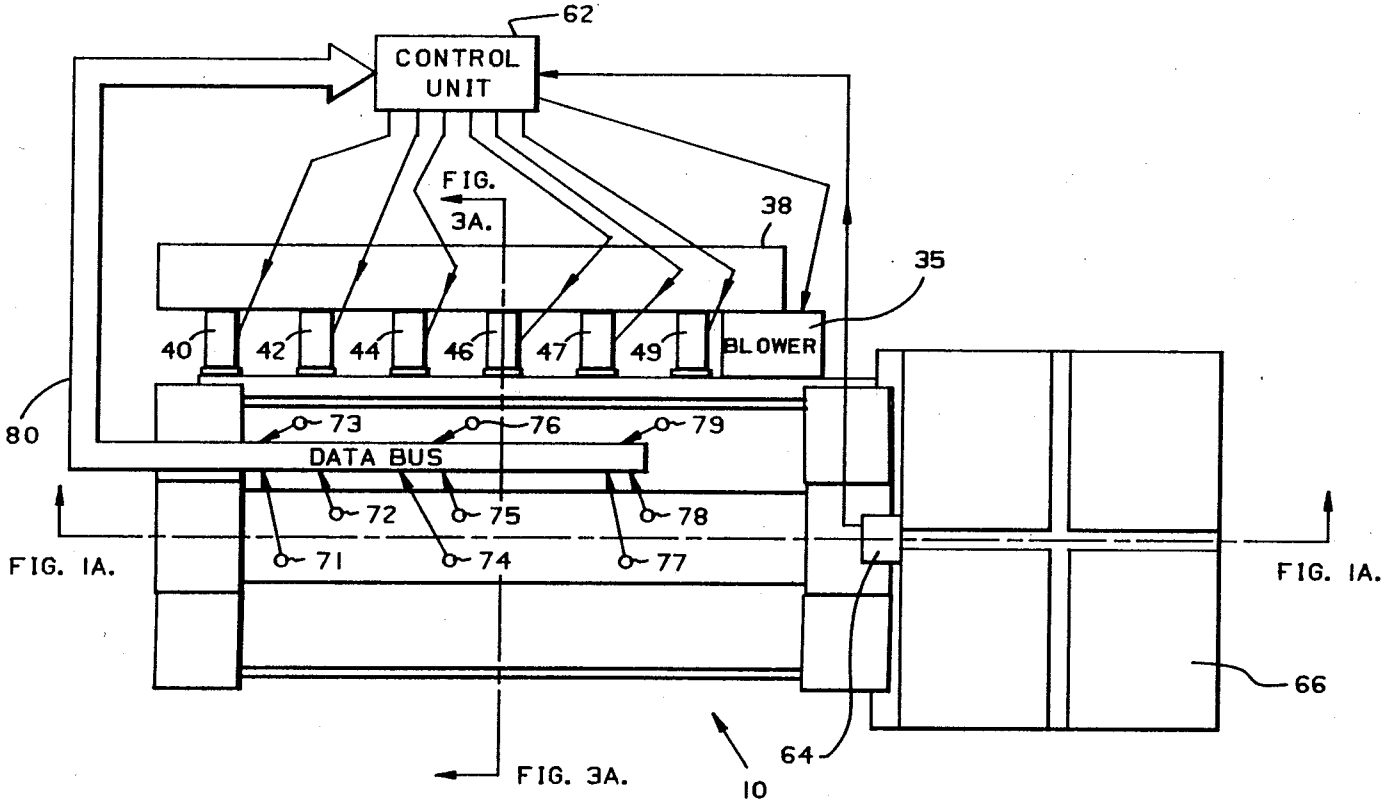
FIG. 1B is a top plan schematic view of the rotary combustor illustrated in FIG. 1A.
Figure 3A:
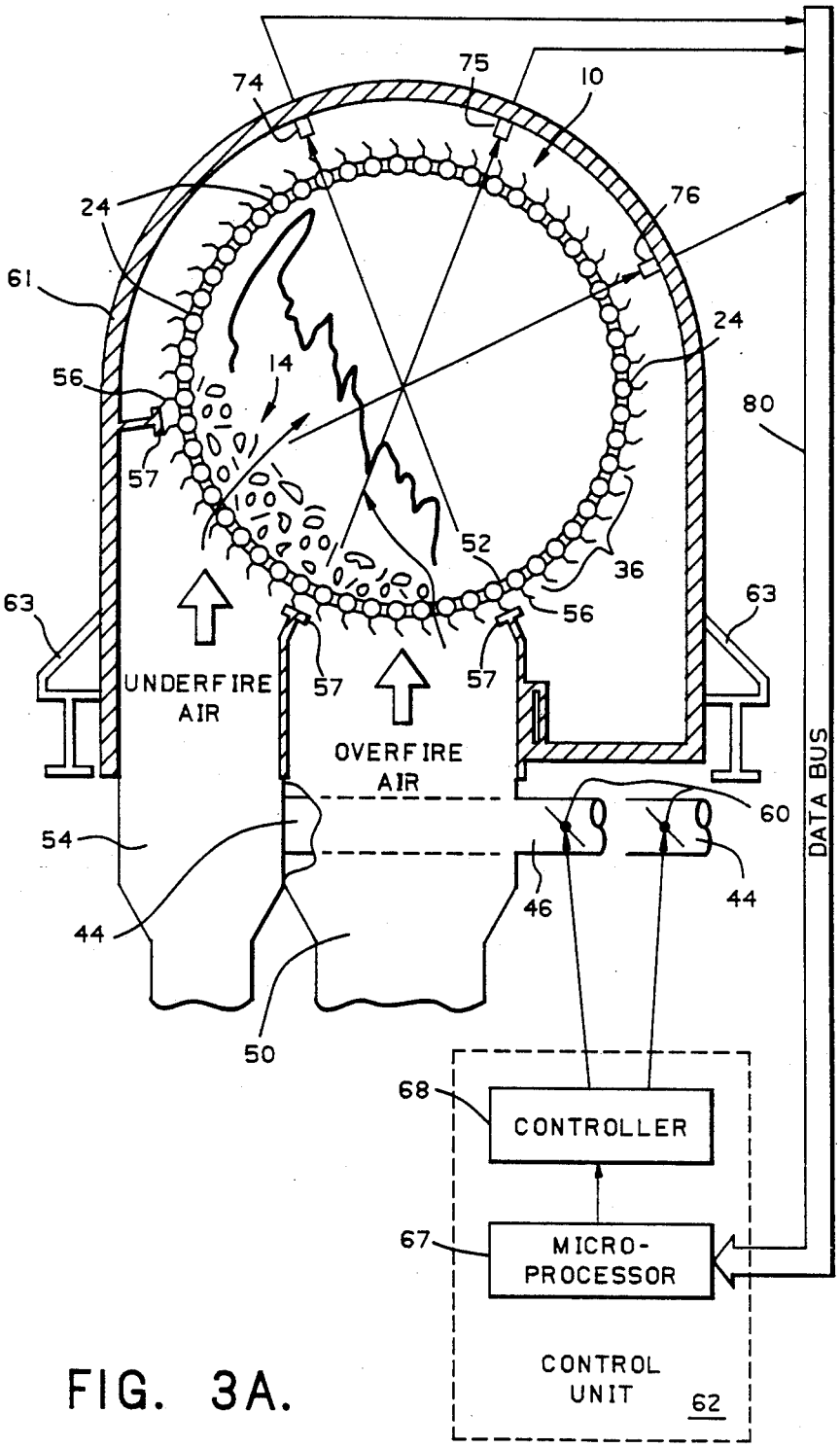
FIG. 3A is a cross-sectional, end elevational schematic view of the rotary combustor illustrated in FIG. 1A.

Referring to Figs. 1A, 1B and 3A, the combustion air is supplied by windboxes 48, 50, 52 and 54 disposed under the combustion barrel 10 an generally perpendicular to the central axis of rotation. The windboxes 33 receive combustion air under pressure from a blower 35 via an air duct 38 and control ducts 40, 42, 44, 46, 47 and 49. The pressure is maintained by seal strips 56 which extend longitudinally along the exterior of the combustion barrel 10 and have a dogleg-shaped cross-section, as illustrated in FIG. 3A. Each of the seal strips 56 is continuous for at least the axial length of one windbox and forms a pressure seal against windbox edges 57 so that the combustion air exiting the windboxes 48, 50, 52 and 54 enters the combustion barrel 10.

The exhaust gases 20 generated by burning the waste material 14 are contained by an enclosure 61, illustrated in FIG. 3A but excluded from FIG. 1A to simplify the drawing. The enclosure 61 is supported on a suitable surface by supports 63. An induced draft fan (not shown) is coupled to the flue 19 downstream from the rotary combustor to maintain the flue 19 at slightly below atmospheric pressure. Thus, essentially all exhaust gases 20 exit from the combustion barrel 10 via the flue 19.

As illustrated in FIG. 3A, combustion air is supplied to the windboxes, e.g., windboxes 50 and 54, via control ducts 46 and 44, respectively, which are supplied with air by the air duct 38, illustrated in Figs. 1A and 1B, but not shown in FIG. 3A. As viewed from the exit end 18, the combustion barrel 10 rotates in a clockwise direction at a slow rate, such as one-sixth rpm. As a result, some of the openings 7 (FIG. 3B) remain uncovered due to shifting of the waste material 14 to one side. These uncovered openings 37 enable the overfire windboxes 48, 50 and 52 to supply "overfire" air from control ducts 42, 46 and 49 to the upper surface of the waste material 14. Simultaneously, "underfire" air from control ducts 40, 44 and 47 is supplied by underfire windboxes, e.g., windbox 54 in the middle of the barrel 10, to the portion of the waste material 14 in contact with the side wall 36. Typically, the waste material 14 includes large, irregularly shaped objects which permit the underfire air to filter through the material 14, at least near the input end 16 of the combustion barrel 10. Combustion is typically initiated in the barrel 10 by using an auxiliary fuel such as oil or natural gas, which can be supplied through the input end 16 of the combustion barrel 10 and cut off after combustion begins, as disclosed in Harris et al. '651.

Figure 2:
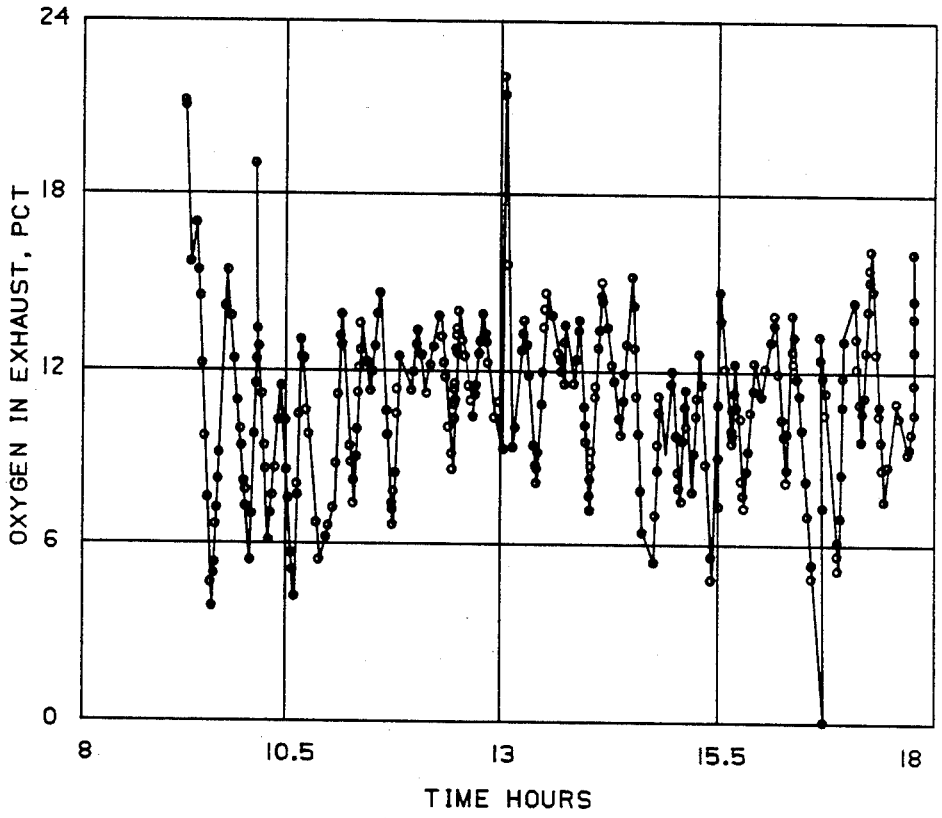
FIG. 2 is a graph of percent oxygen versus time in a prior art rotary combustor.

The pressure in the windboxes is maintained by actuation of dampers 60 at approximately two inches, of water, i.e., slightly less than one-tenth (0.1) psi above the pressure in the barrel 10, which typically is slightly below atmospheric pressure. In prior art rotary combustors, the dampers 60 were adjusted manually and only rarely would the settings be changed. However, as illustrated in FIG. 2, relatively rapid changes in combustion commonly occur in the barrel 10. As a result, the amount of oxygen supplied to combustion zones of the barrel 10 in a prior art rotary combustor was usually either larger or smaller than desired.

According to the present invention and with reference to FIG. 3A, the dampers 60 are controlled by a control unit 62, which ensures even and complete combustion of the waste material 14 and thus overcomes the deficiencies of manual adjustments as performed in the prior art. In a first embodiment of the present invention, a sensor 64 in the flue 19 provides an exhaust gas sensor signal to the control unit 62. The exhaust gas sensor signal indicates the level of a predetermined operating characteristic, such as percentage of oxygen, carbon monoxide or unburned hydrocarbons in the exhaust. The control unit 62 responds to the exhaust gas sensor signal by actuating the dampers 60 to provide desired changes in the supply of combustion air. Thus, when the exhaust gas sensor signal indicates that, e.g., the percentage of oxygen is below a predetermined desired range, the control unit 62 adjusts the dampers 60 to increase the flow of combustion air into the combustion barrel 10 and when the exhaust gas sensor signal indicates that an excessive amount of oxygen is present in the exhaust gases, the supply of combustion air may be reduced.

Additionally, as illustrated in FIG. 1B, the blower 35 may be of a type which provides a variable flow rate in which case the total flow of combustion air supplied to the dampers 60 may be adjusted by varying the output of the blower 35. Also, as an alternative to reducing or increasing the total amount of combustion air supplied to the combustion barrel 10, the distribution of combustion air can also be varied in response to the exhaust gas sensor signal. For example, the flow of combustion air to windboxes 50 and 54 may be modified since most combustion ordinarily occurs above these two windboxes in the middle of the barrel 10.

Also, the response of the exhaust gas sensor signal to an initial adjustment of combustion air supply can be monitored and subsequent modifications to the distribution and total supply of combustion air can be different from the initial adjustment. For example, an initial response to a low percentage of oxygen may be to increase flow to windboxes 50 and 54 and if no significant increase in exhaust oxygen is detected, control ducts 47 and 49 may be adjusted to increase combustion air flow to the overfire windbox 52 and the underfire windbox adjacent thereto.

The sensor 64 preferably detects the percentage of oxygen present in the exhaust gases 20 and may be a Model 6630 oxygen analyzer manufactured by the Combustion Control Division of Westinghouse Electric Corp. As illustrated in FIG. 3A, the control unit 62 preferably comprises a microprocessor 67, such as an INTEL 88/40 and a controller 68, such as a 1300 Series Controller also manufactured by the Combustion Control Division of Westinghouse. The microprocessor 67 can be programmed by one of ordinary skill in the art to respond to the exhaust gas sensor signal, which indicates the percentage of oxygen present in the exhaust gases 20, by generating output signals to adjust the air supplied as the combustion air to the windboxes 48, 50, 52 and 54. The output signals from the microprocessor 67 are supplied to the controller 68 which converts the electrical signals to perform mechanical adjustment of the dampers 60. In addition, although not illustrated in the drawings, the microprocessor 67 might also be used to adjust the composition of the combustion air, e.g., by adding oxygen to enrich the combustion air supplied to a combustion zone severely lacking in oxygen. Preferably, the control unit 62 adjusts the supply of combustion air so that the percentage of oxygen in the exhaust gases is maintained in the range of 5 to 8 percent by volume.

In a second embodiment of the present invention, fire characteristic sensors 71–79 (Figs. 1B) supply fire characteristic sensor signals via a data bus 80 to the microprocessor 67. The fire characteristic sensors 71–79 are preferably photoelectric cells which are sensitive to a specific range of electromagnetic radiation. The photoelectric cells may be sensitive to infrared radiation to detect the temperature of an area above one of the windboxes. One example of an infrared photoelectric cell is the Modline-4 manufactured by IRCON of Niles, Ill. Alternatively, ultraviolet sensitive photoelectric cells, such as the Series C7012 Frame Safeguard manufactured by Honeywell of Minneapolis, Minn., may be used to detect the presence of a flame in the corresponding area. In either case, there typically is provided at least one photoelectric cell corresponding to each windbox. However, some windboxes may not have a corresponding photoelectric cell. For example, the windboxes near the input end 16 may not have a corresponding photoelectric cell, since this is primarily a drying area.

The information provided by the photoelectric cells is used to obtain more precise control of combustion in the combustion barrel 10. When ultraviolet sensors are used to detect the existence of a flame, the fire characteristic sensor signal from one of the ultraviolet sensors indicating that the flame in the corresponding area had become extinguished signifies that the quantity of combustion air being supplied to the corresponding area should be increased. On the other hand, infrared sensors provide quantitative information which can be used in determining how much the flow of combustion air should be increased or decreased.

In a third embodiment, very precise control of combustion is obtained by using all three types of sensors, i.e., an oxygen sensor 64 and a pair of infrared and ultraviolet photoelectric cells in each of the locations of the fire characteristic sensors 71–79. The oxygen sensor 64 provides an exhaust gas sensor signal indicating overall combustion efficiency, while the infrared and ultraviolet sensors provide indications of temperature and existence of a flame, respectively, as fire characteristic sensor signals for corresponding windboxes. Thus, the total amount of combustion air being supplied can be adjusted in response to the exhaust gas sensor signal, while the distribution of the combustion air can be controlled in dependence upon the fire characteristic sensor signals.

Depending upon the size of the openings 37 and the sensitivity and focusing provided by the photoelectric cells 71–79, transparent windows 82 (FIG. 3B) may be formed in the side wall 36 of the barrel 10 to permit a larger quantity of light than that which would pass through the openings 37 in the perforated web 25, to periodically reach the photoelectric cells 71–79. At a typical rotation speed of one-sixth rpm, the provision of six windows 82 for each of the three zones of the combustion barrel 10 produces fire characteristic sensor signals at a rate of one per minute from each of the photoelectric cells. Additional windows 82 can be provided for redundancy.

In the illustrated embodiment of FIGS. 1A, 1B, 3A and 3B, three photoelectric cells, e.g., 74, 75 and 76 in FIG. 3A, are provided for a corresponding pair of underfire and overfire windboxes, e.g., windboxes 50 and 54 in FIG. 3A, although only one photoelectric cell is required to detect a fire characteristic in a corresponding windbox. Furthermore, depending upon the area covered by a photoelectric cell and the position of the cell along the axis of the combustion barrel 10, i.e., the corresponding combustion zone, it is unnecessary to provide a photoelectric cell for each windbox and a single photoelectric cell for both windboxes in a combustion zone can be sufficient. The additional photoelectric cells in the illustrated embodiment provide redundancy to enable continuous operation of the rotary combustor despite failures in a photoelectric cell.

The many features and advantages of the present invention are apparent from the detailed specification, and thus, it is intended by the appended claims to cover all such features and advantages of the device and method which fall within the true spirit and scope of the invention. Further, since numerous modifications and changes will readily occur to those skilled in the art, it is not desired to limit the invention to the exact construction and operation illustrated and described. Accordingly, all suitable modifications and equivalents may be resorted to falling within the scope and spirit of the invention.

What is claimed is:

1. A combustion gas controller for controlling combustion gas supplied to a rotary combustor, the rotary combustor including a combustion barrel having a gas-porous side wall and windboxes disposed underneath the combustion barrel for supplying the combustion gas to the combustion barrel through the gas-porous side wall, said combustion gas controller comprising:

plural sensing means, disposed outside the combustion barrel, for sensing a fire characteristic at a plurality of respective locations in the rotary combustor above a corresponding windbox and generating corresponding fire characteristic sensor signals indicating one of temperature and existence of a flame in the area above the corresponding windbox; and automatic control means, operatively connected to said plural sensing means, for automatically controlling the supply of the combustion gas to the rotary combustor in dependence upon the fire characteristic sensor signals to maintain the fire characteristic at the respective locations according to predetermined criteria.

2. A combustion gas controller as recited in claim 1, wherein:

each of the locations at which the fire characteristic is detected comprises an area above a corresponding windbox; and said automatic control means comprises:

control ducts, each of said control ducts coupled to one of the windboxes having an area above which the fire characteristic is sensed; and means, operatively connected to said sensing means and said control ducts, for separately controlling combustion gas flow in each of the control ducts in dependence upon the fire characteristic sensed above the corresponding windbox.

3. A combustion gas controller as recited in claim 1, wherein said plural sensing means each comprises an infrared photoelectric cell, disposed outside the combustion barrel and operatively connected to said automatic control means, for detecting temperature in the area above the corresponding windbox as the fire characteristic.

4. A combustion gas controller as recited in claim 1, wherein said plural sensing means each comprises an ultraviolet photoelectric cell, disposed outside the combustion barrel and operatively connected to said automatic control means, for detecting the existence of a flame in the area above the corresponding windbox.

5. A combustion gas controller as recited in claim 1, further comprising an oxygen sensor producing an exhaust gas sensor signal indicative of percentage of oxygen in exhaust gases.

* * * * *